US005176819A

United States Patent [19]

Green

[11] Patent Number: 5,176,819

[45] Date of Patent: Jan. 5, 1993

[54] COKING PROCESS WITH HOT SOLIDS RECYCLED TO THE STRIPPING ZONE

[75] Inventor: Robert C. Green, Berkeley Heights, N.J.

[73] Assignee: Exxon Research & Engineering Company, Florham Park, N.J.

[21] Appl. No.: 729,680

[22] Filed: Jul. 15, 1991

[51] Int. Cl.[5] ..... C10G 9/28

[52] U.S. Cl. ..... 208/127; 208/126; 208/160

[58] Field of Search ..... 208/126, 127, 160

[56] References Cited

U.S. PATENT DOCUMENTS 2,893,946 7/1959 Brown ..... 208/127

4,297,202 10/1981 Blaser ..... 208/127

*Primary Examiner*—Theodore Morris

*Assistant Examiner*—William C. Diemler

*Attorney, Agent, or Firm*—Henry E. Naylor

[57] ABSTRACT

An improved fluid coking process which includes: (a) a fluid coker comprised of a coking zone, a scrubbing zone, and a stripping zone; (b) a heater, and optionally a gasifier. The improvement comprises feeding a portion of the heated solids from the heater and/or the gasifier, to the stripping zone. Consequently, the coking zone can be operated at a temperature lower than the stripping zone.

4 Claims, 1 Drawing Sheet

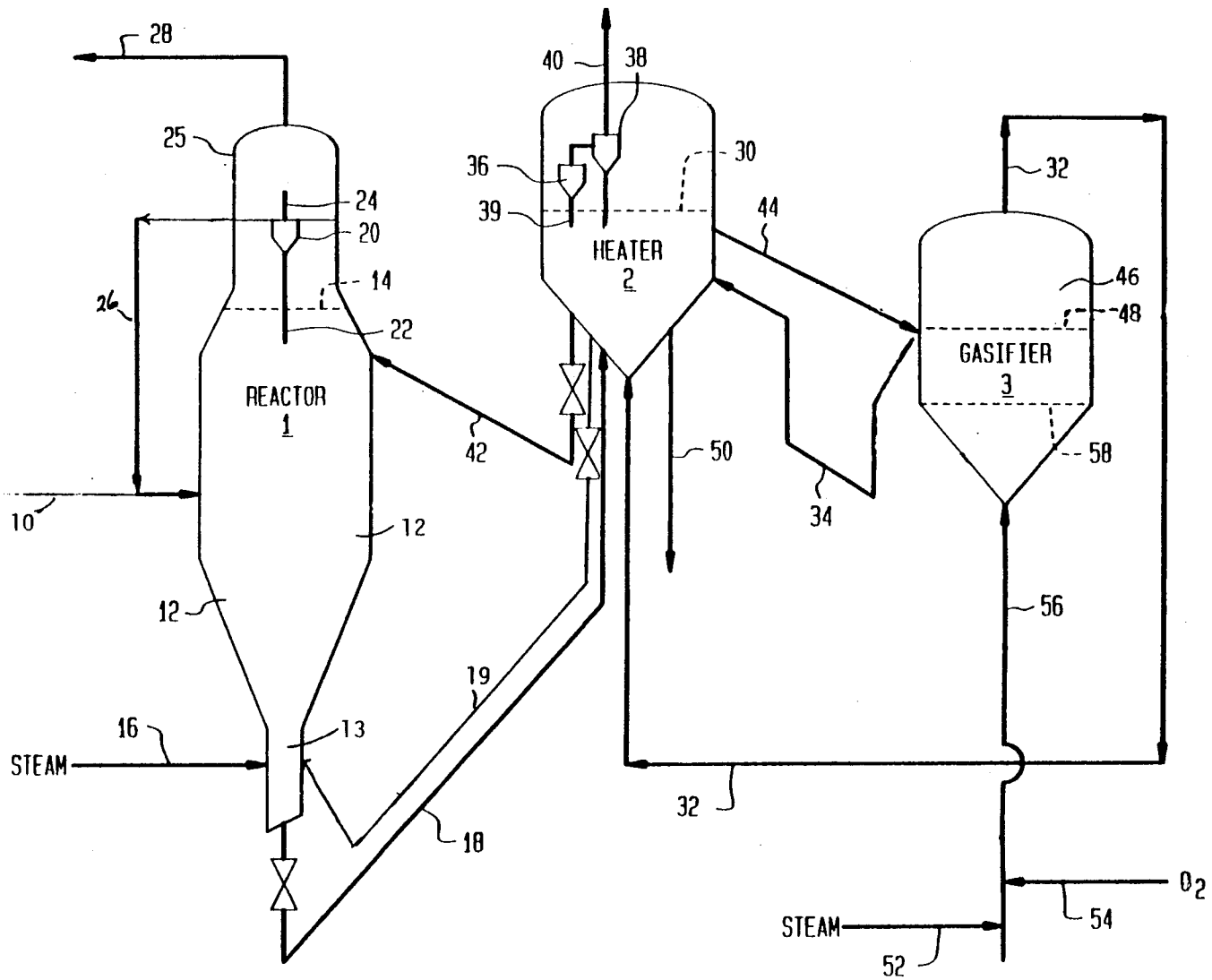
GASIFIER
3
HEATER
2
REACTOR
1
STEAM
STEAM
$O_2$
10
12
12
13
14
16
18
19
20
22
24
25
26
28
30
32
32
34
36
38
39
40
42
44
46
48
50
52
54
56
58

COKING PROCESS WITH HOT SOLIDS RECYCLED TO THE STRIPPING ZONE

FIELD OF THE INVENTION

The present invention relates to an improved fluid coking process wherein hot solids are recycled from the heating zone to the stripping zone. This allows the coking zone to be run at a lower temperature.

BACKGROUND OF THE INVENTION

Much work has been done over the years to convert heavy hydrocarbonaceous materials to more valuable lighter boiling products. Various thermal processes which have resulted from such work include visbreaking; catalytic hydroconversion, in both a slurry and ebullating bed; fluid coking; and delayed coking.

Of particular interest in the practice of the present invention is fluid coking. In fluid coking, a heavy hydrocarbonaceous chargestock, such as a vacuum residuum, is fed to a coking zone comprised of a fluidized bed of hot solid particles, usually coke particles, sometimes also referred to as seed coke. The heavy hydrocarbonaceous material is reacted in the coking zone, resulting in conversion products which include a vapor fraction and coke, which coke is deposited on the surface of the seed coke particles. A portion of the coked-seed particles is sent to a heating zone which is maintained at a temperature higher than that of the coking zone. Some of the coke is burned off in the heating zone. Hot seed particles from the heating zone are returned to the coking zone as regenerated seed particles, which serves as the primary heat source for the coking zone. In some fluid coking processes, a portion of hot coke from the heating zone is circulated back and forth to a gasification zone which is maintained at a temperature greater than that of the heating zone. In the gasifier, substantially all of the remaining coke on the coked seed particles is burned, or gasified, off. Several U.S. patents which teach fluid coking, with or without an integrated gasification zone, are U.S. Pat. Nos. 3,726,791; 4,203,759; 4,213,848; and 4,269,696; all of which are incorporated herein by reference.

Many process modifications have been made over the years in an attempt to achieve higher liquid yields. For example, U.S. Pat. No. 4,378,288 discloses a method for increasing coker distillate yield in a thermal coking process by adding small amounts of a free radical inhibitor.

Notwithstanding any advantages the foregoing processes may have, there is still a need in the art for process variations which can increase liquid yields.

SUMMARY OF THE INVENTION

In accordance with the present invention, there is provided a fluid coking process for converting a heavy hydrocarbonaceous chargestock to lower boiling products, which fluid coking process comprises:

(a) reacting a heavy hydrocarbonaceous chargestock in a fluid coker comprised of: (i) a coking zone containing a fluidized bed of solid particles into which is fed the chargestock; (ii) a scrubbing zone wherein the vapor phase product from the coking zone is passed; and (iii) a stripping zone, at the bottom of said coking zone, for stripping at least a portion of the hydrocarbons which adhere to the solid particles;

(b) removing a stream of the resulting stripped solids from said stripping zone and passing it to a heating zone, which is also comprised of a bed of fluidized solids and which is operated at a temperature greater than that of the coking zone; and (c) recycling a portion of said heated solids from said heating zone to said coking zone.

The improvement which comprises recycling another portion of said heated solids from said heating zone to said fluid coke at the stripping zone.

In a preferred embodiment of the present invention, the coking zone is operated at a lower temperature than the stripping zone.

In yet another preferred embodiment of the present invention, a portion of the solids from the heating zone is passed to a gasification zone which is also comprised of a fluidized bed of solid particles and which is maintained at a temperature greater than that of the heating zone and further wherein the fluidizing gas is a mixture of stream and an oxygen-containing gas.

BRIEF DESCRIPTION OF THE DRAWING

The sole FIGURE hereof is a schematic flow plan of a preferred embodiment of the present invention showing a fluid coking process unit comprised of a coking zone, a scrubbing zone, a stripping zone, a heating zone, and a gasification zone.

DETAILED DESCRIPTION OF THE INVENTION

Any heavy hydrocarbonaceous material which is typically fed to a coking process can be used herein. Generally, the heavy hydrocarbonaceous material will have a Conradson carbon residue of about 5 to 40 wt. % and be comprised of fractions, the majority of which, boil above about 975° F. Suitable hydrocarbonaceous materials include heavy and reduced petroleum crudes, petroleum atmospheric distillation bottoms, petroleum vacuum distillation bottoms, pitch, asphalt, bitumen, liquid products derived from coal liquefaction processes, including coal liquefaction bottoms, and mixtures thereof.

A typical petroleum chargestock suitable for the practice of the present invention will have composition and properties within the ranges set forth below.

| | |
|---|---|
| Conradson Carbon | 5 to 40 wt. % |
| Sulfur | 1.5 to 8 wt. % |
| Hydrogen | 9 to 11 wt. % |
| Nitrogen | 0.2 to 2 wt. % |
| Carbon | 80 to 86 wt. % |
| Metals | 1 to 2000 wppm |
| Boiling Point | 340° C.+ to 650° C.+ |
| Specific Gravity | −10 to 35° API |

Reference is now to the FIGURE hereof, which shows an integrated coking/gasification unit where most of the coke is gasified with a mixture of steam and air in a gasification zone. A heavy hydrocarbonaceous chargestock is passed via line 10 to coking zone 12 of coker reactor 1, which coking zone is comprised of a fluidized bed of seed particles having an upper level indicated at 14. Although it is preferred that the seed material, be coke particles, they may also be other refractory materials selected from the group consisting of silica, alumina, zirconia, magnesia, alumdum or mullite. They may also be synthetically prepared, or naturally occurring material, such as pumice, clay, kieselguhr, diatomaceous earth, bauxite, and the like. The seed particles are preferably those having an average particle size of about 40 to 1000 microns, preferably from about 40 to 400 microns.

A fluidizing gas e.g. steam, is admitted at the base of coker reactor 1, through line 16, into a stripping zone 13 of the coker reactor, in an amount sufficient to obtain superficial fluidizing velocity. Such a velocity is typically in the range of about 0.5 to 5 ft/sec. A portion of the feed forms a fresh coke layer on the fluidized seed particles. The coke is partially stripped of fresh coke and occluded hydrocarbons in the stripping zone 13 by use of said steam and carried via line 18 to the heating zone 2.

A portion of hot coke from the heating zone is admitted to reactor 1 by line 42. The heating zone is maintained at a temperature above the temperature maintained in the coking zone. For example, at a temperature from about 100° to 400° F., preferably from about 150° to 350° F., and more preferably about 150° F. to 250° F. in excess of the actual operating temperature of the coking zone. The heated solids are sent to the coking zone in an amount sufficient to maintain the coking temperature in the range of about 850° to 1200° F. The pressure in the coking zone is maintained in the range of about 0 to 150 psig, preferably in the range of about 5 to 45 psig. The lower portion of the coking reactor serves as a stripping zone to remove occluded hydrocarbons from the coke.

Another portion of hot coke from the heating zone is passed via line 19 to the stripping zone 13. This allows for controlling the temperature of the stripping zone independent of the temperature of the coking, or reactor zone. This is important because it allows one to lower the temperature of the coking zone to achieve higher liquid yields. In conventional fluid coking, higher temperatures than needed for maximum liquid yields are maintained in the coking zone to prevent defluidization of the seed particles. This is particularly true in the stripping zone which is most susceptible to defluidization. Increasing the stripping zone temperature will also improve stripping. It is also to be understood that a portion of hot coke particles can also be passed from the gasification zone to the stripping zone. These hot coke particles from the gasifier to the stripping zone may be in addition to, or in place of, the coke particles from the heating zone.

Conversion products are passed through cyclone 20 to remove entrained solids which are returned to coking zone through dipleg 22. The vapors leave the cyclone through line 24, and pass into a scrubbing zone 25 mounted on the coking reactor. A stream of heavy materials condensed in the scrubbing zone may be recycled to the coking reactor via line 26. The coker conversion products are removed from the scrubber 25 via line 28 for fractionation in a conventional manner.

Stripped coke from the stripping zone 13 of coking reactor 1 (cold coke) is introduced by line 18 to a fluidized bed of hot coke particles in heater 2 having an upper level indicated at 30. The bed is partially heated by passing a fuel gas into the heater by line 32 from the gasifier. Supplementary heat is supplied to the heater by coke circulating from gasifier 3 through line 34. The gaseous effluent of the heater, including entrained solids, passes through a cyclone which may be a first cyclone 36 and a second cyclone 38 wherein the separation of the larger entrained solids occur. The separated larger solids are returned to the heater bed via the respective cyclone diplegs 37 and 39. The heated gaseous effluent which contains entrained solids is removed from heater 2 via line 40.

Hot coke is removed from the fluidized bed in heater 2 and recycled to coking reactor by line 42 to supply heat thereto. Another portion of coke is removed from heater 2 and passed by line 44 to a gasification zone 46 in gasifier 3 in which is maintained a bed of fluidized coke particles having a level indicated at 48. If desired, a purged stream of coke may be removed from heater 2 by line 50.

The gasification zone is maintained at a temperature ranging from about 1600° to 2000° F. and at a pressure ranging from about 0 to 150 psig, preferably at a pressure ranging from about 25 to about 45 psig. Steam by line 52, and a molecular oxygen-containing gas, such as air, commercial oxygen, or air enriched with oxygen by line 54, pass via line 56 into gasifier 3. The reaction of the coke particles in the gasification zone with the steam and the oxygen-containing gas produces a hydrogen and carbon monoxide-containing fuel gas. The gasified product gas, which may further contain some entrained solids, is removed overhead from gasifier 3 by line 32 and introduced into heater 2 to provide a portion of the required heat as previously described.

Having thus described the present invention, and a preferred and most preferred embodiment thereof, it is believed that the same will become even more apparent by reference to the following examples. It will be appreciated, however, that the examples, as well as the figures hereof, are presented for illustrated purposes and should not be construed as limiting the invention.

EXAMPLE

A fluid coking unit is operated with a reactor temperature of 977° F., a stripper temperature of 975° F. and a heater temperature of 1167° F. Circulation of solids from the bottom of the stripper to the burner is 75 tons/minute. Yield of liquid products is approximately 74 percent of feed. Approximately 8 tons/minute of hot solids from the heater are then fed to the stripper and 8 tons/minute fewer hot solids are fed from the heater to the reactor. Reactor temperature decreases to 957° F. with stripper and heater temperature being unchanged. Yield of liquid products from the reactor are calculated to increase to 75 percent. The 1% increase in liquid yield is significant and would represent a substantial increase in operating profit because of the large volume of feedstock processed in a commercial coking unit.

What is claimed is:

1. In a fluid coking process wherein a heavy hydrocarbonaceous chargestock is converted to lower boiling products, which fluid coking process comprises:

(a) reacting a heavy hydrocarbonaceous chargestock in a fluid coker comprised of: (i) a coking zone containing a fluidized bed of solid particles and maintained at a temperature from about 850° F. to about 1200° F. and a pressure from about 0 to 150 psig, into which is fed the chargestock; (ii) a scrubbing zone wherein the vapor phase product of the coking zone is passed; and (iii) a stripping zone at the bottom of said coking zone for removing at least a portion of adherent hydrocarbons from the solids;

(b) removing a stream of the resulting stripped solids from said stripping zone and passing it to a heating zone which is operated at a temperature from about 100° F. to about 400° F. in excess of said coking zone, also comprised of a bed of fluidized solids;

(c) recycling a portion of said heated solids from said heating zone to said fluid coker at the coking zone; and (d) passing another portion of said heated solids from said heating zone to a gasification zone which is maintained at a temperature from about 1600° F. to about 2000° F. in the presence of steam, with the proviso that the gasification zone be maintained at a temperature higher than that of the heating zone;

the improvement which comprises recycling a portion of said gasified heated solids from the gasification zone to said fluid coker at the stripping zone.

2. The process of claim 1 wherein the hydrocarbonaceous chargestock is selected from the group consisting of heavy and reduced petroleum crudes, petroleum atmospheric distillation bottoms, petroleum vacuum distillation bottoms, pitch, asphalt, bitumen, and liquid products derived from coal liquefaction processes.

3. The process of claim 2 wherein the chargestock has a Conradson carbon residual of about 5 to 40 wt. %.

4. The process of claim 3 wherein a portion of the solids in the gasification zone are recycled to the heating zone.

* * * * *